US011898434B2

(12) United States Patent
Wheater et al.

(10) Patent No.: US 11,898,434 B2
(45) Date of Patent: Feb. 13, 2024

(54) WELLBORE DEPTH INSTRUMENT

(71) Applicants: Guy Wheater, London (GB); Stuart Huyton, Moray (GB)

(72) Inventors: Guy Wheater, London (GB); Stuart Huyton, Moray (GB)

( * ) Notice: Subject to any disclaimer, the term of this patent is extended or adjusted under 35 U.S.C. 154(b) by 20 days.

(21) Appl. No.: 17/860,492

(22) Filed: Jul. 8, 2022

(65) Prior Publication Data

US 2024/0011386 A1 Jan. 11, 2024

(51) Int. Cl.
*E21B 47/04* (2012.01)
*E21B 44/00* (2006.01)
*E21B 44/04* (2006.01)

(52) U.S. Cl.
CPC ..... *E21B 44/005* (2013.01); *E21B 44/04* (2013.01); *E21B 47/04* (2013.01)

(58) Field of Classification Search
CPC ..... E21B 47/04
See application file for complete search history.

(56) References Cited

U.S. PATENT DOCUMENTS 4,454,655 A * 6/1984 Ellis ..... G01B 5/02 33/544.2
2012/0186874 A1* 7/2012 Malone ..... E21B 47/13 175/45
2016/0032711 A1* 2/2016 Sheiretov ..... E21B 45/00 73/152.54

* cited by examiner

*Primary Examiner* — Kristyn A Hall
(74) *Attorney, Agent, or Firm* — Tumey L.L.P.

(57) ABSTRACT

A wellbore depth instrument (WDI) for measuring wellbore depths along a wellbore, acting as an odometer. In one embodiment, the WDI may be mounted onto a downhole tool-string deployed by a pipe, coil, e-line, or slickline. Further, the WDI may comprise two independently suspended wheels of fixed diameter with respective internal electronic packages that each may record in memory rotations of their respective wheels and frequencies of those rotations along the wellbore. Such recordings may allow for accurate determination and characterization of tool-string dynamics (e.g., tool-string speed, direction, stick slip, creep and hold-ups) as well as absolute and relative tool-string position along a wellbore (i.e., wellbore depth).

20 Claims, 7 Drawing Sheets

16
244
250
246
254

238
236
240
242
258
14
256
DOWN-HOLE
234
232
12
WDI-22-01
WELLBORE DEPTH INSTRUMENT
GAIA EARTH TECHNOLOGIES
MADE IN GREAT BRITAIN
230
78
206
22
204
WDI-22-01
198
4
224
231
24
80
207
205
22
199
6
225

WELLBORE DEPTH INSTRUMENT

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

Field of the Invention

The present invention relates to a measurement device for use in downhole operations for subsurface wells, including oil, gas, and water wells. More particularly, the present invention relates to a wellbore depth instrument that may be mounted on a downhole tool-string and allows for accurate determination and characterization of tool-string dynamics as well as absolute and relative tool-string position along a wellbore (i.e., wellbore depth from an odometer).

Background of the Invention

During the well delivery process, or interventions thereafter, tool-string dynamics such as tool-string speed, direction, stick-slip, creep, and hold-ups, as well as absolute and relative tool-string position along a wellbore (i.e., wellbore depth) are critical parameters for a tool-string operator to know. For instance, an operator may desire to know the well depth at which certain formations may be encountered during drilling or desire to know the well depth of certain well zones that may need evaluation via logging tools. Furthermore, well depth, typically measured in ftMD (Measured Depth in feet) or mMD (Measured Depth in meters), may be a defining parameter for most work orders in well services and surveys.

Currently, well depth may be measured by drill pipe and draw-works movements. However, among other things, well depth measurement by drill pipe and draw-works movements may suffer from pipe tally measurement errors at surface or mechanical, thermal, and hydraulic effects downhole, such as drill pipe stretch and compression, as well as rig motion relative to the seabed (on floaters), and may therefore result in erroneous well depth measurements. Further, well depth may be measured by wireline or slickline services which in all but the most benign environments, may possess well depth measurement errors. Typically, wireline or slickline services employ depth counter wheels at surface that record the amount of spooled cable or wire going in the wellbore. However, errors may often be generated by these depth counter wheels due to cable compression and slippage, as they record the surface movement of cable and not the actual tool-string movements downhole. When a tool-string may be logged up in a wellbore, the surface tension increases and the cable stretches, i.e., a certain amount of wire may be pulled past the depth counter wheels at the surface before the tool actually starts moving; thus, a recording system may place the tool at a shallower depth than the tool's actual depth at that time. In order to mitigate this issue, the amount of cable stretch may be computed by an operator or estimated by computing the tool-string response (i.e., gamma ray), which may be accomplished by running the tool-string in hole and pulling it out of hole at the same speed as the survey demands. The gamma ray response may reveal the amount of stretch to be added to the depth system to match the UP log with the DOWN log (reference log), which in some cases may be up to 30-40 ftMD or more for deep or tortuous wells. While calculating the amount of cable stretch may be helpful, accurate calculation may be difficult to achieve, and the amount of stretch will change as the tool is logged up the hole. In highly deviated wells, the tension distribution along the wire may be non-linear and the addition of a single stretch correction may be unreliable, and further the well temperature may affect the wire stretch coefficient and a single depth correction may not apply for other depths in the wellbore (i.e., shallower or deeper than current depth).

Consequently, there is a need for a wellbore depth instrument (e.g., an odometer) that may be mounted on a downhole tool-string that allows for accurate determination and characterization of tool-string dynamics as well as wellbore depth.

BRIEF SUMMARY OF SOME OF THE PREFERRED EMBODIMENTS

These and other needs in the art are addressed in one embodiment by a measurement device for a wellbore comprising an upper and lower tool mount body, each comprising a laterally extending cylindrical bore that allows the upper and lower tool bodies to mount onto a tool-string; a pair of side rails, each comprising an upper portion, a lower portion, and a center portion, wherein the upper portion of each of the pair of side rails is coupled to the upper tool mount body on opposing sides, wherein the lower portion of each of the pair of side rails is coupled to the lower tool mount body on opposing sides, wherein the center portion provides separation between the upper and lower tool mount bodies, and wherein the coupling of the pair of side rails to the upper and lower bodies form a combined upper/lower tool mount body; and a pair of wheel suspension assemblies coupled to the combined upper/lower tool mount body on opposing sides, each comprising a wheel assembly comprising a traction wheel and an electronics package, wherein the electronics package is capable of recording in memory rotations of the traction wheel and frequency of the rotations; an upper and lower biasing element; and an upper and lower Scott Russel linkage, wherein the upper Scott Russel linkage couples the wheel assembly to the upper tool mount body and the upper biasing element, and wherein the lower Scott Russel linkage couples the wheel assembly to the lower tool mount body and the lower biasing element, and wherein the upper and lower biasing elements of the pair of wheel suspension assemblies bias the upper and lower Scott Russel linkages of the pair of wheel suspension assemblies in an axially inward direction, thereby biasing the traction wheels of the pair of wheel suspension assemblies in a downward direction perpendicular to the axial inward direction.

These and other needs in the art are addressed in one embodiment by a method for determining well depth measurements along a wellbore comprising mounting a wellbore depth instrument onto a tool-string designed for downhole operations, wherein the wellbore depth instrument comprises an upper and lower tool mount body, each comprising a laterally extending cylindrical bore that allows the upper and lower tool bodies to mount onto a tool-string; a pair of side rails, each comprising an upper portion, a lower portion, and a center portion, wherein the upper portion of each of the pair of side rails is coupled to the upper tool mount body on opposing sides, wherein the lower portion of each of the pair of side rails is coupled to the lower tool mount body on opposing sides, wherein the center portion provides separation between the upper and lower tool mount bodies, and wherein the coupling of the pair of side rails to the upper and lower bodies form a combined upper/lower tool mount body; a pair of wheel suspension assemblies coupled to the combined upper/lower tool mount body on opposing sides, each comprising a wheel assembly comprising a traction wheel and an electronics package; an upper and lower biasing element; and an upper and lower Scott Russel linkage, wherein the upper Scott Russel linkage couples the wheel assembly to the upper tool mount body and the upper biasing element, and wherein the lower Scott Russel linkage couples the wheel assembly to the lower tool mount body and the lower biasing element, and wherein the upper and lower biasing elements of the pair of wheel suspension assemblies bias the upper and lower Scott Russel linkages of the pair of wheel suspension assemblies in an axially inward direction, thereby biasing the traction wheels of the pair of wheel suspension assemblies in a downward direction perpendicular to the axial inward direction, wherein the biasing of the traction wheels allows the tractions wheels to remain in contact with a wall of the wellbore through upward and downward movement during a downhole operations run; running the tool-string up or down the wellbore, thereby causing rotation of the traction wheels; allowing the electronics packages to record in memory rotations of their respective traction wheels and frequencies of the rotations; and determining well depth measurements along the wellbore via the recorded rotations of the traction wheels and frequencies of the rotations.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
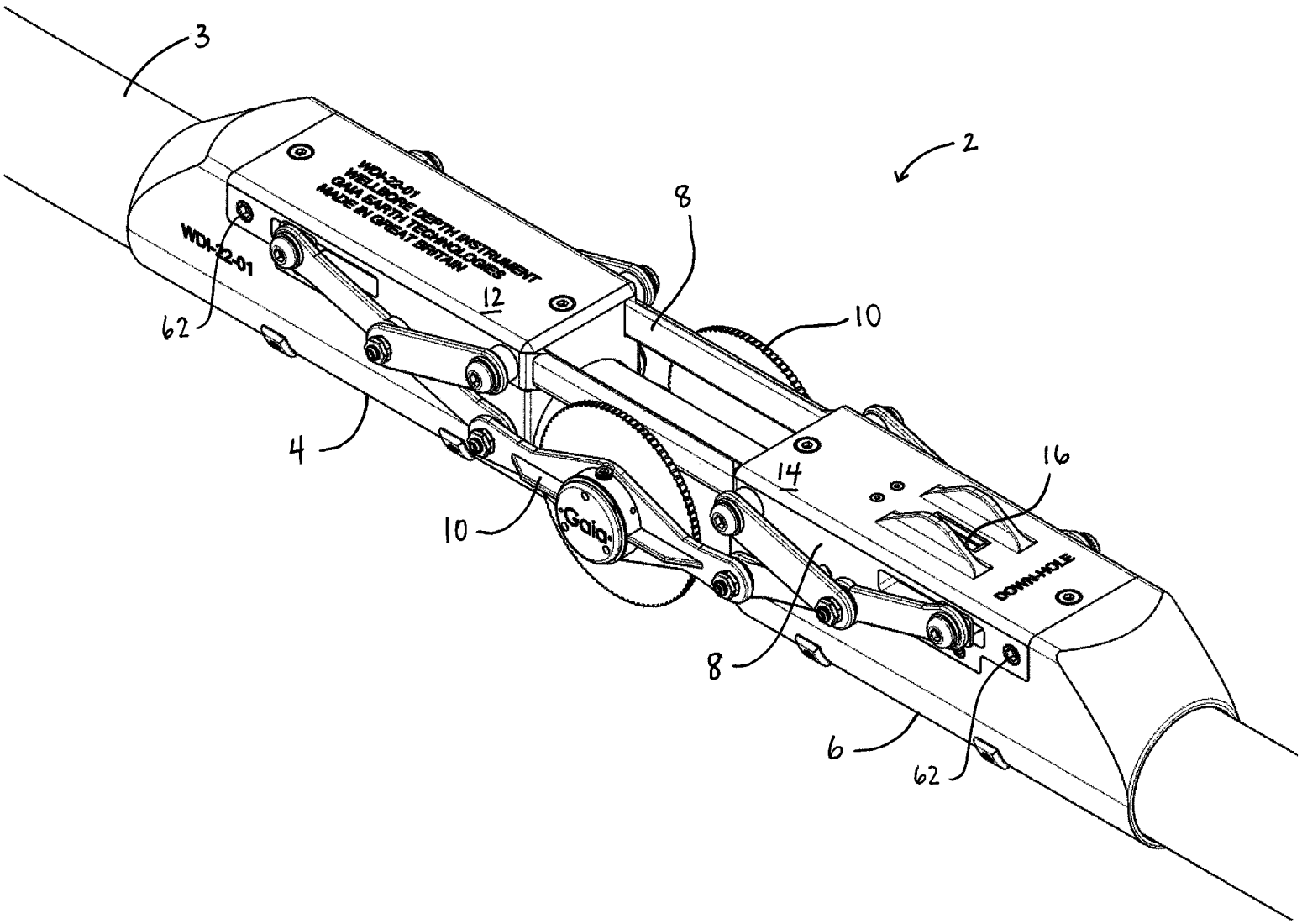
FIG. 1 illustrates a perspective view of a wellbore depth instrument in accordance with one embodiment of the present invention.

FIG. 1 illustrates an embodiment of a wellbore depth instrument (WDI) 2. In embodiments, WDI 2 may be a device capable of being mounted onto a downhole tool-string 3 deployed by a pipe, coil, e-line, or slickline that allows for accurate determination and characterization of tool-string dynamics (e.g., tool-string speed, direction, stick slip, creep and hold-ups) as well as absolute and relative tool-string position along a wellbore (i.e., wellbore depth). WDI 2 may comprise an upper and lower tool mount body 4 and 6, a pair of side rails 8, a pair of wheel suspension assemblies 10, a top and bottom cover plate 12 and 14, and an internal sensor package 16.

Figure 2:
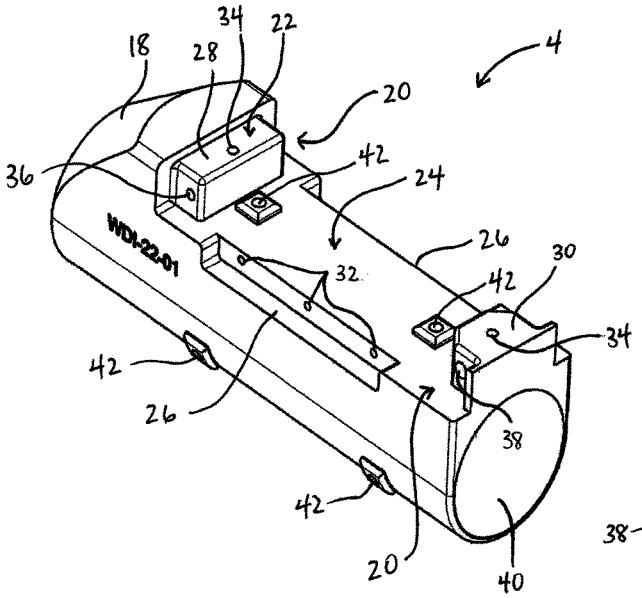
FIG. 2 illustrates a perspective view of an upper and lower tool mount body in accordance with one embodiment of the present invention.
Figure 2:
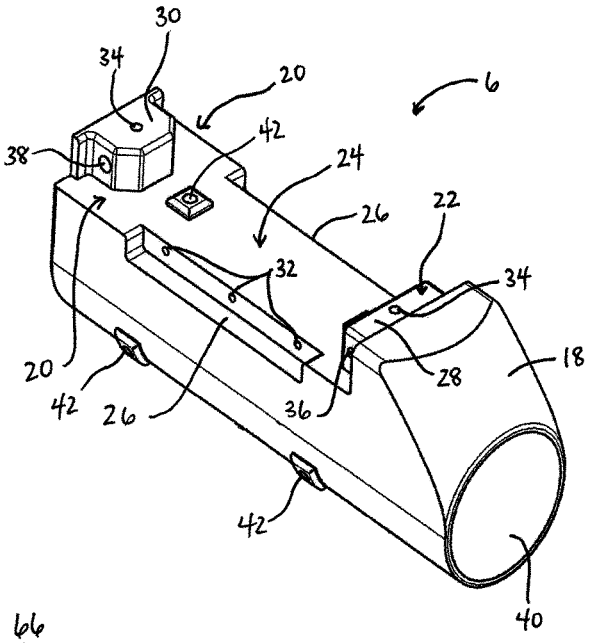

FIG. 2 illustrates a perspective view of upper and lower tool mount body 4 and 6 which may be cylinder/rectangular prism composite shapes machined from a solid billet material or the like. In embodiments, upper and lower tool mount body 4 and 6 may each comprise a rounded bottom portion and a squared-off top portion. As illustrated, the squared-off top portion of each tool mount body may comprise at least one tapered end 18 and one or more recesses. In embodiments the one or more recesses may comprise a pair of side rail recesses 20, a cover plate recess 22, and a biasing element recess 24. Altogether, the one or more recesses may result in upper and lower tool mount body 4 and 6 each comprising a pair of side rail shelves 26 disposed on opposing sides of each tool mount body. Each side rail shelf 26 may comprise one or more side rail pilot holes 32 that may be threaded and of any suitable size. In embodiments, each side rail shelf 26 may comprise three side rail pilot holes 32 that may be evenly spaced and capable of receiving M6 screws. Further, the one or more recesses may result in upper and lower tool mount body 4 and 6 each comprising a first and second projection element 28 and 30. First projection element 28 may comprise a cover plate pilot hole 34 disposed on its top surface and two additional side rail pilot holes 36 disposed on its side surfaces at opposing ends. Second projection element 30 may also comprise a cover plate pilot hole 34 disposed on its top surface, but differently comprise two fixed element pilot holes 38 disposed on its side surfaces at opposing ends. In embodiments, cover plate pilot holes 34, additional side rail pilot holes 36, and fixed element pilot holes 38 may be threaded and of any suitable size. In some embodiments, cover plate pilot holes 34 and additional side rail pilot holes 36 may be capable of receiving M8 screws, while fixed element pilot holes 38 may be capable of receiving M12 bolts.

As further illustrated in FIG. 2, upper and lower tool mount body 4 and 6 may each further comprise a cylindrical bore 40 that extends laterally through upper and lower tool mount body 4 and 6. In embodiments, cylindrical bore 40 may allow for the mounting of each tool mount body onto downhole tool-string 3, and to facilitate secure mounting, upper and lower tool mount body 4 and 6 may comprise one or more fixing holes 42 extending from an outer surface of each tool mount body to cylindrical bore 40. In embodiments, one or more fixing holes 42 may comprise at least one set of three fixing holes 42 phased at 120 degrees about each tool mount body such that two fixing holes 42 from the at least one set may be disposed on the rounded bottom portion of each tool mount body and one fixing hole 42 from the at least one set may be disposed at the biasing element recess of the tool mount body. One or more fixing holes 42 may be threaded and of any suitable size. In embodiments, one or more fixing holes 42 may be capable of receiving M10 screws, namely one or more fixing hole grub screws (not illustrated).

Figure 3:
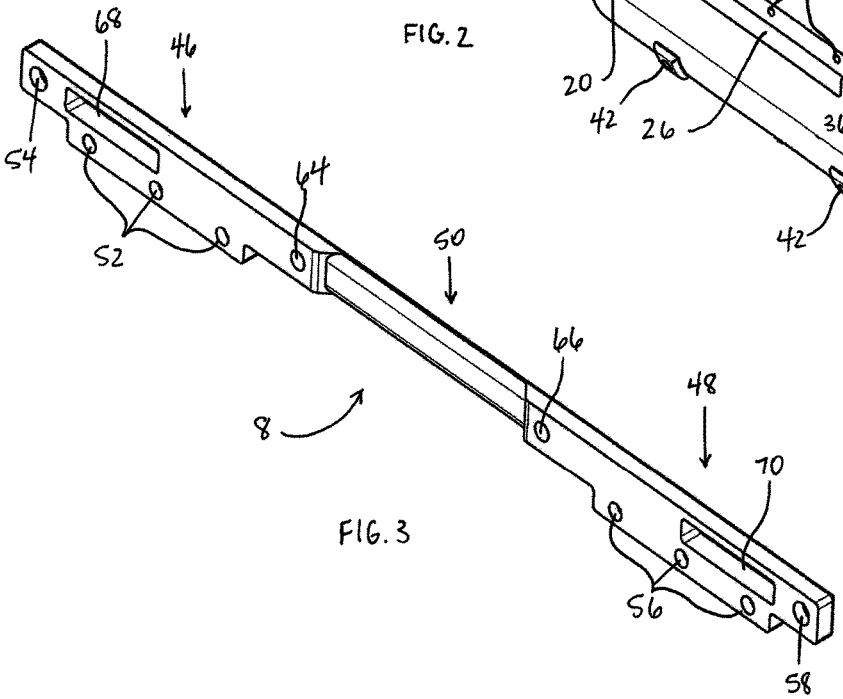
FIG. 3 illustrates a perspective view of a side rail in accordance with one embodiment of the present invention.

FIG. 3 illustrates a perspective view of one of the pair of side rails 8 that may be coupled to the upper and lower tool mount body 4 and 6. In embodiments, each side rail 8 may be machined from any material such as a metal and comprise an upper side rail portion 46 configured to be received by one of the side rail recesses 20 of upper tool mount body 4, a lower side rail portion 48 configured to be received by one of the side rail recesses 20 of lower tool mount body 6, and a center side rail portion 50 configured to provide suitable space between upper and lower tool mount body 4 and 6 when WDI 2 may be assembled. To facilitate coupling, upper side rail portion 46 may comprise upper side rail clearance holes 52 and an additional upper side rail clearance hole 54, each of the holes comprising an optional counterbore. In embodiments, upper side rail clearance holes 52 may each correspond in position and size to side rail pilot holes 32 of one of the side rail shelves 20 of upper tool mount body 4, while additional upper side rail clearance hole 54 may correspond in position and size to one of the additional side rail pilot holes 36 of first projection element 28 of upper tool mount body 4. Similarly to upper side rail portion 46, lower side rail portion 48 may comprise lower side rail clearance holes 56 and an additional lower side rail clearance hole 58, each of the holes comprising an optional counterbore. In embodiments, lower side rail clearance holes 56 may each correspond in position and size to side rail pilot holes 32 of one of the side rail shelves 20 of lower tool mount body 6, while additional lower side rail clearance hole 58 may correspond in position and size to one of the additional side rail pilot holes 36 of first projection element 28 of lower tool mount body 6. Upper side rail clearance holes 52 and 54 as well as lower side rail clearance holes 56 and 58 may be any suitable size, however in some embodiments upper and lower side rail clearance holes 52 and 56 may be capable of receiving M6 screws, namely side rails screws (not illustrated), and additional upper and lower side rail clearance hole 54 and 58 may each be capable of receiving an M8 screw, namely additional side rail screws 62 (illustrated in FIG. 1). The side rail screws may fasten through upper and lower side rail clearance holes 52 and 56 and into side rail pilot holes 32 of side rail shelves 26 of upper and lower tool mount body 4 and 6, and further additional side rail screws 62 may each fasten through additional upper and lower side rail clearance hole 54 and 58, respectively, and into additional side rail pilot holes 36 of first projection element 28 of upper and lower tool mount body 4 and 6. As such, the pair of side rails 8 may be secured to upper and lower tool mount body 4 and 6 on opposing sides, and thereby connect upper and lower tool mount body 4 and 6 to form a combined upper/lower tool mount body.

As further illustrated in FIG. 3, each side rail 8 may further comprise an upper and lower fixed element clearance hole 64 and 66 as well as an upper and lower sliding element cutout guide 68 and 70. In embodiments, upper fixed element clearance hole 64 may correspond in position to one of the fixed element pilot holes 38 of second projection element 30 of upper tool mount body 4, while lower fixed element clearance hole 66 may correspond in position to one of the fixed element pilot holes 38 of second projection element 30 of lower tool mount body 6. Further, upper sliding element cutout guide 68 may correspond in position to biasing element recess 24 of upper tool mount body 4, while lower element cutout guide 70 may correspond in position to biasing element 24 of lower tool mount body 6. In embodiments, the height and length of upper and lower sliding element cutout guide 68 and 70 may each be dimensioned to be within the height and length of biasing element recess 24 of upper and lower tool mount body 4 and 6, respectively.

Figures 4A, 4B, 4C:
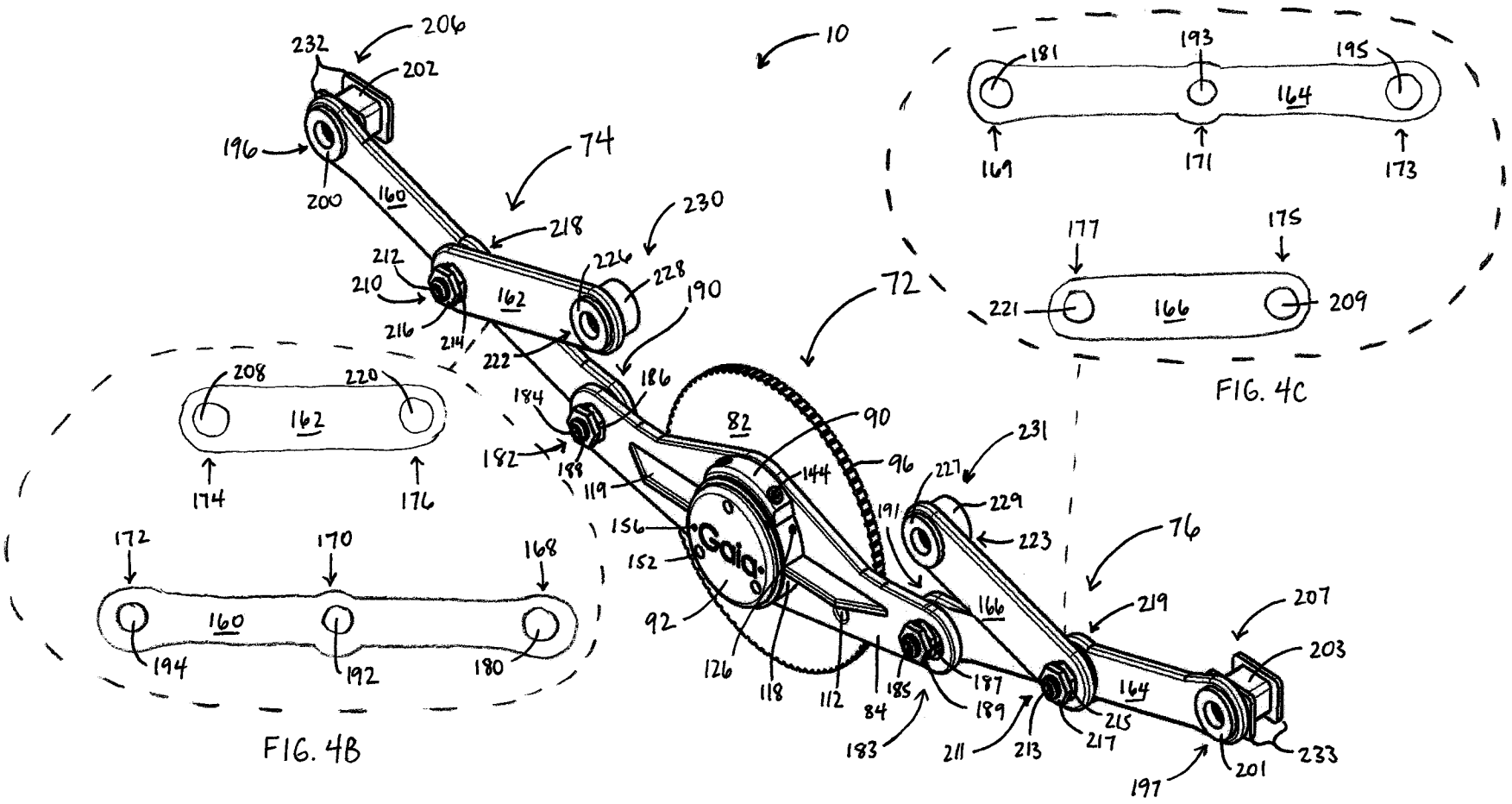
FIG. 4A illustrates a perspective view of a wheel suspension assembly in accordance with one embodiment of the present invention.
FIGS. 4B and 4C illustrate lever components utilized in the wheel suspension assembly in accordance with one embodiment of the present invention.
Figure 5A:
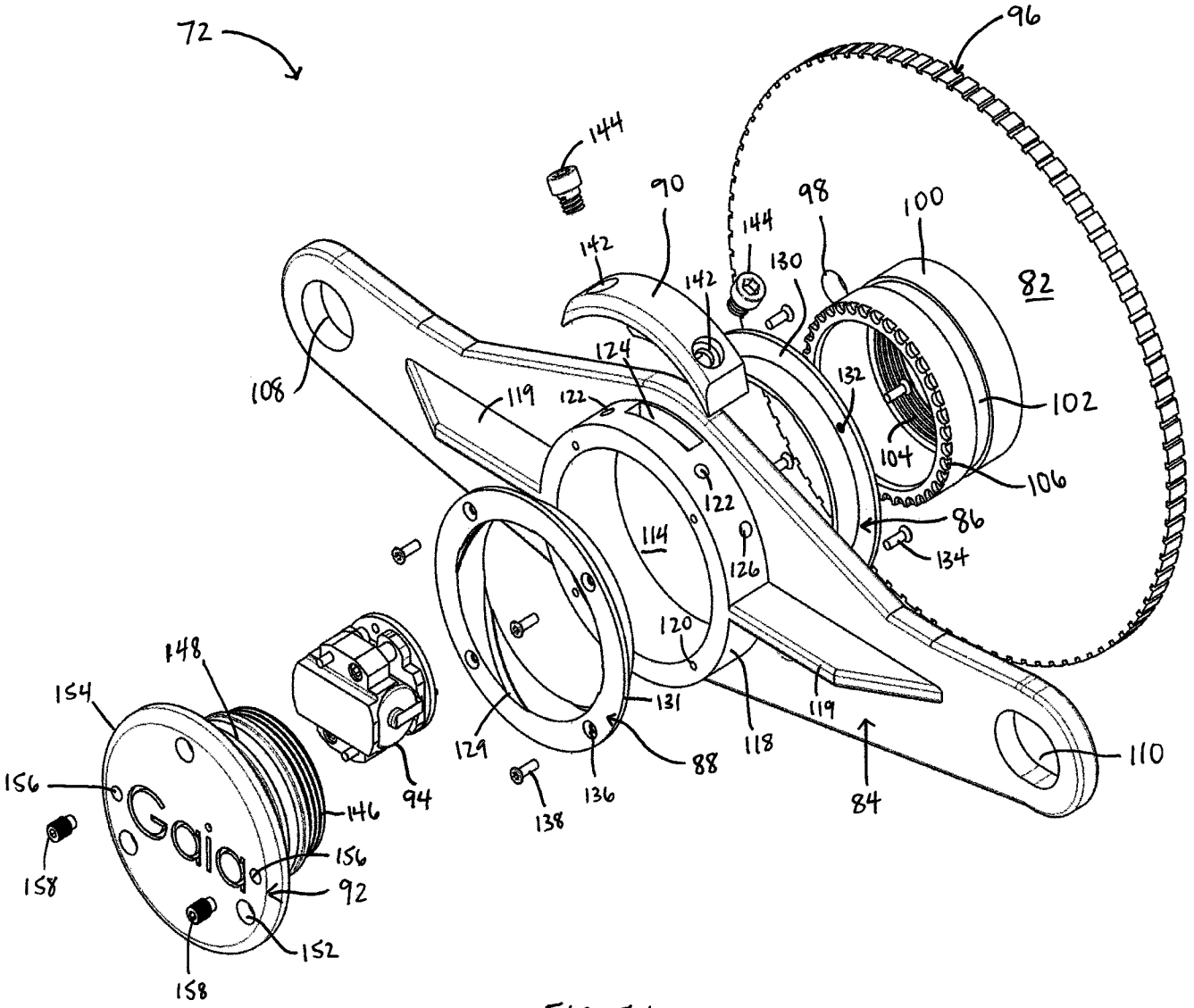
FIGS. 5A-5B illustrate exploded views of a wheel assembly in accordance with one embodiment of the present invention from opposing perspectives.
Figure 5B:
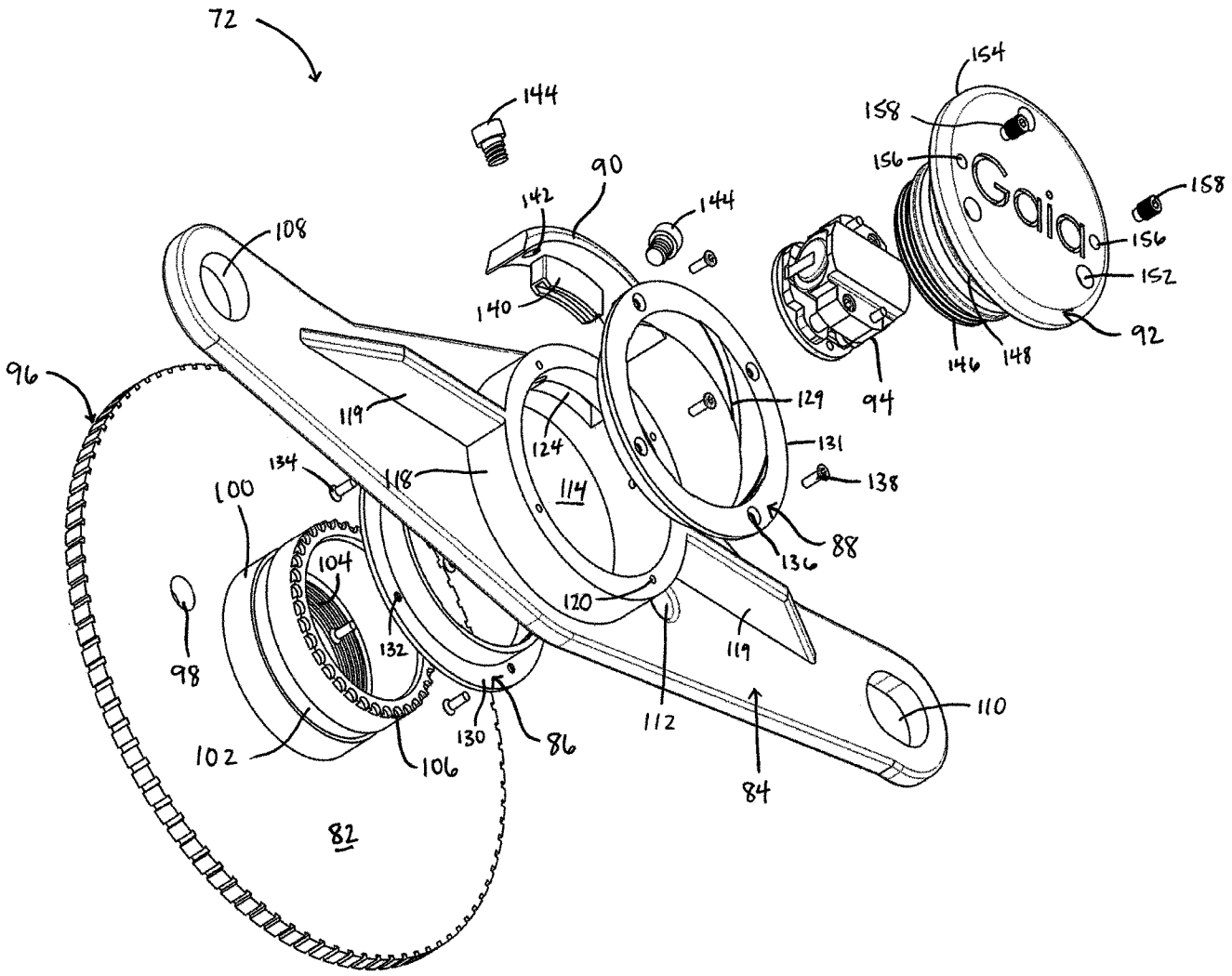

FIG. 4A illustrates a perspective view of one of the pair of wheel suspension assemblies 10 which may be coupled to the combined upper/lower tool mount body. Each wheel suspension assembly 10 may comprise a wheel assembly 72. In embodiments, wheel assembly 72, as further illustrated in exploded views from different perspectives in FIGS. 5A-5B may comprise a traction wheel 82, a wheel carrier 84, an inner and outer bushing 86 and 88, a radial wheel guide 90, a hubcap 92, and an electronics package 94.

Traction wheel 82 may be a wheel of a fixed diameter comprising a toothed circumference 96, a first wheel locking hole 98, and a hub 100. In embodiments, hub 100 may comprise a wheel alignment groove 102 disposed on its outer surface, internal threads 104 disposed on its inner surface, and anti-rotation slots 106 disposed on an edge about its circumference and capable of receiving M4 screws.

Wheel carrier 84 may comprise an inward facing side and an outward facing side as well as a circular wheel assembly connection hole 108, an oblong wheel assembly connection hole 110, a second wheel locking hole 112, and a central opening 114. Second wheel locking hole 112 may correspond to first wheel locking hole 98 of traction wheel 82. As such, first wheel locking hole 98 of traction wheel 82 and second wheel locking hole 112 of wheel carrier 84 may be used in conjunction with a locking rod to prevent rotation of traction wheel 82 during assembly and disassembly of wheel assembly 72. Central opening 114 may be of a circular shape and comprise one or more inner bushing screw pilot holes (not illustrated) disposed about its circumference on the inward facing side of wheel carrier 84. The one or more inner bushing screw pilot holes may be threaded and of any suitable size. In some embodiments, wheel carrier 84 may comprise four inner bushing screw pilot holes capable of receiving M3 screws. Further, central opening may comprise a raised hollow cylindrical projection 118 disposed about its circumference on the outward facing side of wheel carrier 84. Raised hollow cylindrical projection 118 may comprise one or more outer bushing screw pilot holes 120 disposed on its face and one or more radial wheel guide screw pilot holes 122, a radial wheel guide spigot clearance slot 124, and a grease injection port 126 disposed on its curved surface. Similarly to the one or more inner bushing screw pilot holes, one or more outer bushing screw pilot holes 120 may be threaded and of any suitable size. In some embodiments, raised hollow cylindrical projection 118 may comprise four outer bushing screw pilot holes 120 capable of receiving M3 screws. Further, one or more radial wheel guide pilot holes 122 may also be threaded and of any suitable size. In some embodiments, raised hollow cylindrical projection 118 may comprise two radial wheel guide pilot holes 122 capable of receiving M4 screws. Finally, wheel carrier 84 may further comprise a pair of flanges 119 radiating outward from raised hollow cylindrical projection 118 on the outward facing side.

Inner and outer bushing 86 and 88 may be configured to be received by central opening 114 from the inner facing side and the outer facing side of wheel carrier 84, respectively. In embodiments, inner and outer bushing 86 and 88 may each comprise a phosphor bronze bushing with helical grease grooves 128 and 129 as well as flanges 130 and 131. Flange 130 of inner bushing 86 may comprise one or more inner bushing screw clearance holes 132, each with optional counterbore, corresponding in position and size to the one or more inner bushing screw pilot holes. In embodiments, one or more inner bushing screw clearance holes 132 may be capable of receiving M3 screws, namely one or more inner bushing screws 134 that may fasten through one or more inner bushing screw clearance holes 132 and into the one or more inner bushing screw pilot holes. Similarly to flange 130 of inner bushing 86, flange 131 of outer bushing 88 may comprise one or more outer bushing screw clearance holes 136, each with optional counterbore, corresponding in position and size to one or more outer bushing screw pilot holes 120. In embodiments, one or more outer bushing screw clearance holes 136 may be capable of receiving M3 screws, namely one or more outer bushing screws 138 that may fasten through one or more outer bushing screw clearance holes 136 and into one or more outer bushing screw pilot holes 120.

Radial wheel guide 90 may be a component capable of retaining traction wheel 82 within wheel carrier 84. In embodiments, radial wheel guide 90, which may be of a curved shape that corresponds to the curved surface of raised hollow cylindrical projection 118, may comprise a radial wheel guide spigot 140. Radial wheel guide spigot 140 may correspond in size and shape to radial wheel guide spigot clearance slot 124 and thereby be capable of traveling through the radial wheel guide spigot clearance slot 124 and be received by wheel alignment groove 102. Further, radial wheel guide 90 may comprise one or more radial wheel guide screw clearance holes 142, each with optional counterbore, corresponding in position and size to the one or more radial wheel guide screw pilot holes 122. In embodiments, one or more radial wheel guide screw clearance holes 142 may be capable of receiving M4 screws, namely one or more radial wheel guide screws 144 that may fasten through one or more radial wheel guide clearance holes 142 and into one or more radial wheel guide screw pilot holes 122. Upon assembly, hub 100 of traction wheel 82 may be received within inner and outer bushing 86 and 88 installed within central opening 114 of wheel carrier 84, wherein inner and outer bushing 86 and 88 may be dimensioned so as not to obstruct wheel alignment groove 102 from receiving radial wheel guide spigot 140, thus allowing radial wheel guide 90 to securely retain traction wheel 82 inside wheel carrier 84.

Hubcap 92 may be a cover for hub 100 of traction wheel 82 comprising a hollow cylindrical portion and a top portion. The hollow cylindrical portion may comprise a hubcap threading 146 on at least a portion of its external surface that may correspond to and be received by internal threads 104 of hub 100. In addition, the hollow cylindrical portion of hubcap 92 may comprise one or more hubcap grooves 148 that may each be capable of receiving an O-ring (not illustrated). In embodiments, the O-ring(s) may allow for a seal between hubcap 92 and hub 100. The top portion may comprise one or more tightening holes 152 disposed on its outer surface. In embodiments, one or more tightening holes 152 may be three holes phased at 120 degrees. Further, the top portion of hubcap 92 may comprise a hubcap flange 154 having one or more anti-rotation screw clearance holes 156, each with optional counterbores, corresponding in position and size to anti-rotation slots 106. In embodiments, one or more anti-rotation screw clearance holes 156 may be capable of receiving M4 screws, namely one or more anti-rotation screws 158 that may fasten through one or more anti-rotation screw clearance holes 156 and into anti-rotation slots 106 of hub 100 of traction wheel 82, thereby capable of preventing independent rotation between traction wheel 82 and hubcap 100.

Electronics package 94 may be an electronics package housed within hubcap 92, comprising a 14 bit, 8g dual axis accelerometer (X-Y) with a 3 mm×3 mm×1 mm package size, 50,000 g-shock tolerance, and programmable internal noise filters. Further, electronics package 94 may comprise a microprocessor and a battery (e.g., a ½ AA battery). In embodiments, electronics package 94 may be capable of data acquisition for 7 days @ 30 ms (rated to 125° C., with limit to 175° C.). Further, an internal clock may be calibrated over operating temperature range with target drift less than 0.5 s per day. For setup and data retrieval, electronics package 94 may be compatible with a docking station to program the package and download the data at surface. In embodiments, electronics package 94 may be capable of recording in memory rotations of traction wheel 82 and frequency of the rotations to allow for accurate determination of dynamic characteristics of downhole tool-string 3 to which WDI 2 may be attached as well as absolute and relative position of downhole tool-string 3 within a wellbore (i.e., wellbore depth).

As further illustrated in FIG. 4A-4C, each wheel suspension assembly 10 may further comprise an upper and lower Scott Russel linkage 74 and 76. Upper Scott Russel linkage 74 may comprise an upper long lever 160 and an upper short lever 162, whereas lower Scott Russel linkage 76 may similarly comprise a lower long lever 164 and a lower short lever 166. In embodiments, both upper long lever 160 and lower long lever 164 may each comprise a wheel assembly end 168 and 169, respectively, a center point 170 and 171, respectively, and a sliding element end 172 and 173, respectively. Further, both upper short lever 162 and lower short lever 166 may each comprise a long lever end 174 and 175, respectively, and a fixed element end 176 and 177, respectively.

In regards to upper long lever 160, wheel assembly end 168 may comprise a wheel assembly connection hole 180 corresponding to circular wheel assembly connection hole 108 of wheel carrier 84, wherein wheel assembly end 168 of upper long lever 160 and wheel carrier 84 of wheel assembly 72 may be connected together via wheel assembly connection hole 180, circular wheel assembly connection hole 108, and a fastening mechanism 182. In embodiments, fastening mechanism 182 may comprise a lever bolt 184 with a grease injection port, a lever bushing 186 with grease ports and channels, and a lever nut 188. Lever bolt 184 may be an M10 sized bolt received by wheel assembly connection hole 180 of upper long lever 160, and further by lever bushing 186 disposed within circular wheel assembly connection hole 108, and fastened by lever nut 188, thus resulting in an upper wheel assembly connection point 190. Further in regards to upper long lever 160, center point 170 may comprise a short lever connection hole 192 which may be discussed in greater detail below. Finally, sliding element end 172 of upper long lever 160 may comprise a sliding element connection hole 194 corresponding to at least a portion of upper sliding element cutout guide 68 disposed on upper side rail portion 46 of one of the pair of side rails 8. Sliding element end 172 and an upper biasing element 78 may be connected together via sliding element connection hole 194 and an upper sliding mechanism 196. In embodiments, upper sliding mechanism 196 may comprise a lever bolt 198 (illustrated in FIG. 6A) of M12 size with one or more grease injection points and a threaded portion, a lever bushing 200 with grease ports and channels, and a sliding bushing 202 that may be of cylindrical or rectangular shape and disposed within upper sliding element cutout guide 68 of one of the pair of side rails 8. Sliding bushing 202 may comprise a borehole and two flanged ends 232 that maintain placement of sliding bushing 202 within upper sliding element cutout guide 68. In embodiments, one of the two flanged ends 232 may be removable via screw fasteners to aid in sliding bushing 202 installation onto side rail 8. Further, upper sliding mechanism 196 may comprise a lever nut 204 (illustrated in FIG. 6A) with a biasing element connection point. Upon assembly, lever bolt 198 may be received by lever bushing 200 disposed within sliding element connection hole 194, and further by the borehole of sliding bushing 202, and fastened by lever nut 204, thus resulting in an upper sliding end connection point 206. In embodiments, upper sliding mechanism 196 may be cable of sliding axially within upper sliding element cutout guide 68 of one of the pair of side rails 8.

In regards to upper short lever 162, long lever end 174 may comprise a long lever connection hole 208 corresponding to short lever connection hole 192 of upper long lever 160, wherein long lever end 174 of upper short lever 162 and center point 170 of upper long lever 160 may be connected together via long lever connection hole 208, short lever connection hole 192, and a fastening mechanism 210. In embodiments, fastening mechanism 210, similarly to fastening mechanism 182, may comprise a lever bolt 212 with a grease injection port, a lever bushing 214 with grease ports and channels, and a lever nut 216. Lever bolt 212 may be an M10 sized bolt received by short lever connection hole 192 of upper long lever 160, and further by lever bushing 214 disposed within long lever connection hole 208 of upper short lever 162, and fastened by lever nut 216, thus resulting in an upper short lever connection point 218. Further in regards to upper short lever 162, fixed element end 176 may comprise a fixed element connection hole 220 corresponding to upper fixed element clearance hole 64 disposed on upper side rail portion 46 of one of the pair of side rails 8 as well as one of the fixed element pilot holes 38 disposed on second projection element 30 of upper tool mount body 4. Fixed element end 176 of upper short lever 162 and upper tool mount body 4 may be connected together via fixed element connection hole 220, one of the fixed element pilot holes 38, and an upper fastening mechanism 222. In embodiments, upper fastening mechanism 222 may comprise a lever bolt 224 (illustrated in FIG. 6A) of M12 size with a grease injection port, a threaded portion, and a biasing element connection point. Further, upper fastening mechanism 222 may comprise a lever bushing 226 with grease ports and channels and a fixed element bushing 228. Upon assembly, lever bolt 224 may be received by lever bushing 226 disposed within fixed element connection hole 220, and further by fixed element bushing 228 disposed between upper short lever 162 and one of the pair of side rails 8. Further, lever bolt 224 may be received by upper fixed element clearance hole 64 of one of the pair of side rails 8, to be threadedly fastened into one of the fixed element pilot holes 38 of upper tool mount body 4, thus resulting in an upper fixed end connection point 230.

In regards to lower long lever 164, which may be similar to upper long lever 160, wheel assembly end 169 may comprise a wheel assembly connection hole 181 corresponding to oblong wheel assembly connection hole 110 of wheel carrier 84, wherein wheel assembly end 169 of lower long lever 164 and wheel carrier 84 of wheel assembly 72 may be connected together via wheel assembly connection hole 181, oblong wheel assembly connection hole 110, and a fastening mechanism 183. In embodiments, fastening mechanism 183 may comprise a lever bolt 185 with a grease injection port, a lever bushing 187 with grease ports and channels, and a lever nut 189. Lever bolt 185 may be an M10 sized bolt received by wheel assembly connection hole 181 of lower long lever 164, and further by lever bushing 187 disposed within oblong wheel assembly connection hole 110, and fastened by lever nut 189, thus resulting in a lower wheel assembly connection point 191. Oblong wheel assembly connection hole 110 may allow for a least some independent movement (10 mm) of lower wheel assembly connection point 191 that may aid in preventing wheel suspension assemblies 10 from locking up downhole. Further in regards to lower long lever 164, center point 171 may comprise a short lever connection hole 193 which may be discussed in greater detail below. Finally, sliding element end 173 of lower long lever 164 may comprise a sliding element connection hole 195 corresponding to at least a portion of lower sliding element cutout guide 70 disposed on lower side rail portion 48 of one of the pair of side rails 8. Sliding element end 173 and a lower biasing element 80 may be connected together via sliding element connection hole 195 and a lower sliding mechanism 197. In embodiments, lower sliding mechanism 197 may comprise a lever bolt 199 (illustrated in FIG. 6A) of M12 size with one or more grease injection points and a threaded portion, a lever bushing 201 with grease ports and channels, and a sliding bushing 203 that may be of cylindrical or rectangular shape and disposed within lower sliding element cutout guide 70 of one of the pair of side rails 8. Sliding bushing 203 may comprise a borehole and two flanged ends 233 that maintain placement of sliding bushing 203 within lower sliding element cutout guide 70. In embodiments, one of the two flanged ends 233 may be removable via screw fasteners to aid in sliding bushing 203 installation onto side rail 8. Further, lower sliding mechanism 197 may comprise a lever nut 205 with a biasing element connection point. Upon assembly, lever bolt 199 may be received by lever (illustrated in FIG. 6A) bushing 201 disposed within sliding element connection hole 195, and further by the borehole of sliding bushing 203, and fastened by lever nut 205, thus resulting in a lower sliding end connection point 207. In embodiments, lower sliding mechanism 197 may be cable of sliding axially within lower sliding element cutout guide 70 of one of the pair of side rails 8.

In regards to lower short lever 166, similarly to upper short lever 162, long lever end 175 may comprise a long lever connection hole 209 corresponding to short lever connection hole 193 of lower long lever 164, wherein long lever end 175 of lower short lever 166 and center point 171 of lower long lever 164 may be connected together via long lever connection hole 209, short lever connection hole 193, and a fastening mechanism 211. In embodiments, fastening mechanism 211, similarly to fastening mechanism 183, may comprise a lever bolt 213 with a grease injection port, a lever bushing 215 with grease ports and channels, and a lever nut 217. Lever bolt 213 may be an M10 sized bolt received by short lever connection hole 193 of lower long lever 164, and further by lever bushing 215 disposed within long lever connection hole 209 of lower short lever 166, and fastened by lever nut 217, thus resulting in a lower short lever connection point 219. Further in regards to lower short lever 166, fixed element end 177 may comprise a fixed element connection hole 221 corresponding to lower fixed element clearance hole 66 disposed on lower side rail portion 48 of one of the pair of side rails 8 as well as one of the fixed element pilot holes 38 disposed on second projection element 30 of lower tool mount body 6. Fixed element end 177 of lower short lever 164 and lower tool mount body 6 may be connected together via fixed element connection hole 221, one of the fixed element pilot holes 38, and a lower fastening mechanism 223. In embodiments, lower fastening mechanism 223 may comprise a lever bolt 225 (illustrated in FIG. 6A) of M12 size with a grease injection port, a threaded portion, and a biasing element connection point. Further, lower fastening mechanism 223 may comprise a lever bushing 227 with grease ports and channels and a fixed element bushing 229. Upon assembly, lever bolt 225 may be received by lever bushing 227 disposed within fixed element connection hole 221, and further by fixed element bushing 229 disposed between lower short lever 166 and one of the pair of side rails 8. Further, lever bolt 225 may be received by lower fixed element clearance hole 66 of one of the pair of side rails 8, to be threadedly fastened into one of the fixed element pilot holes 38 of lower tool mount body 6, thus resulting in a lower fixed end connection point 231.

Figures 6A, 6B:
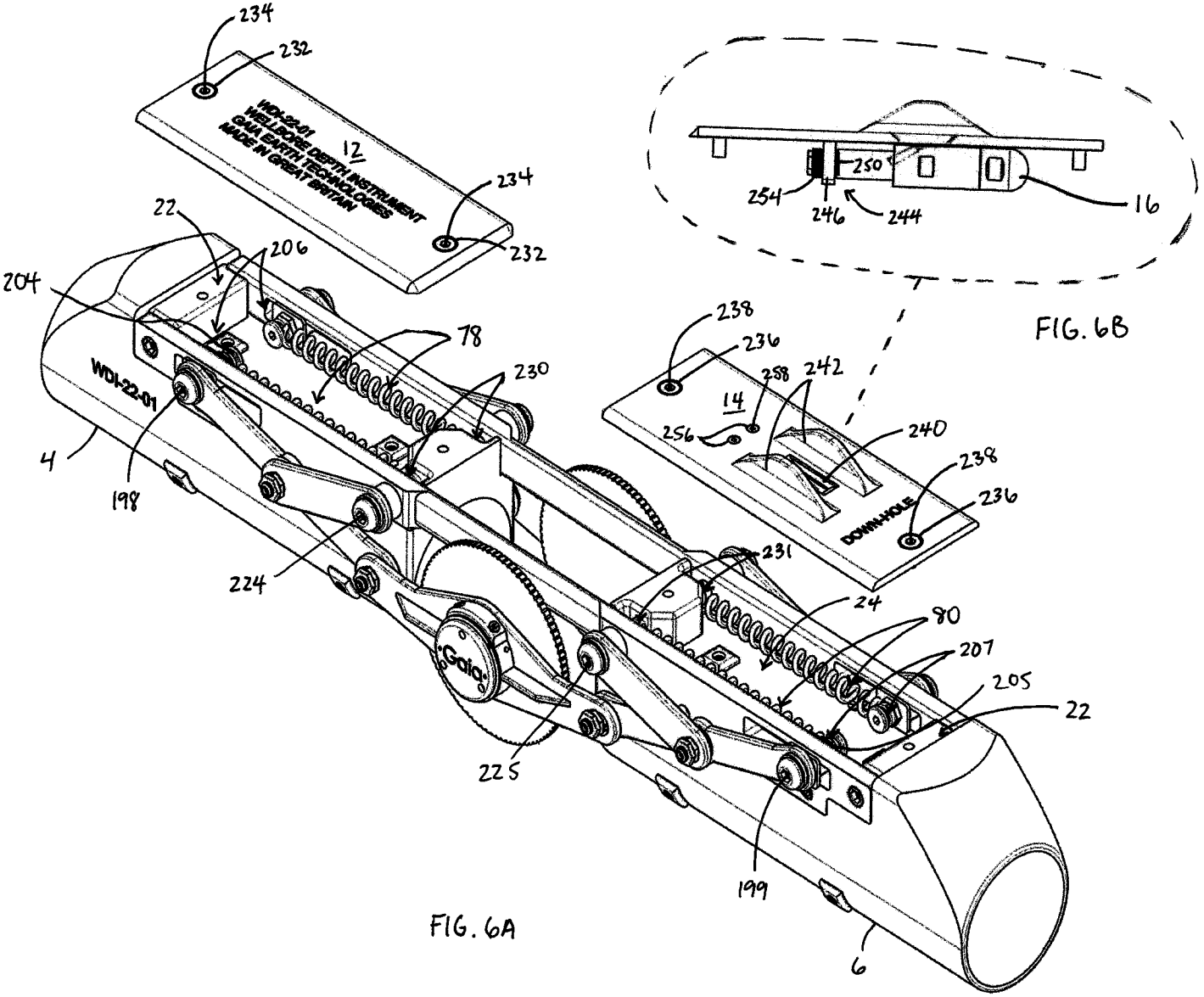
FIG. 6A illustrates a partially exploded view of a wellbore depth instrument in accordance with one embodiment of the present invention.
FIG. 6B illustrates a side view of a sensor package in accordance with one embodiment of the present invention.

As illustrated in FIG. 6A, each wheel suspension assembly 10 may further comprise upper and lower biasing elements 78 and 80 made of tension springs. In embodiments, upper biasing element 78 may be coupled to the biasing element connection point of upper sliding end connection point 206 at one end and the biasing element connection point of upper fastening mechanism 222 of upper fixed end connection point 230 at the other end. Further, lower biasing element 80 may be coupled to the biasing element connection point of lower sliding end connection point 207 at one end and the biasing element connection point of lower fastening mechanism 223 of lower fixed end connection point 231 at the other end. In embodiments, biasing elements 78 and 80 may bias upper and lower sliding end connection points 206 and 207 of Scott Russel linkages 74 and 76 axially inward, thus biasing traction wheel 82 of each wheel suspension assembly 10 in a downward direction perpendicular to the axial movement of upper and lower sliding end connection points 206 and 207. This may allow traction wheel 82 of each wheel suspension assembly 10 to remain in contact with a formation of the wellbore by allowing upward and downward movement to accommodate changes in the formation. In embodiments, the pair of wheel suspension assemblies 10 may be independently suspended and secured to the combined upper/lower tool mount body on opposing sides.

FIG. 6A further illustrates, in a partially exploded view of WDI 2, top and bottom cover plate 12 and 14 which may be machined from any material such as metal. Top cover plate 12 may be configured to be received by cover plate recess 22 of upper tool mount body 4 and bottom cover plate 14 may be configured to be received by cover plate recess 22 of lower tool mount body 6.

In embodiments, top cover plate 12 may comprise top cover plate clearance holes 232, each with optional counterbore, corresponding in position and size to cover plate pilot holes 34 of first and second projection elements 28 and 30 of upper tool mount body 4. Top cover plate clearance holes 232 may be capable of receiving M8 screws, namely top cover plate screws 234 that may fasten through top cover plate clearance holes 232 and into cover plate pilot holes 34 of first and second projection elements 28 and 30 of upper tool mount body 4, thereby capable securing top cover plate 12 to upper tool mount body 4.

In embodiments, bottom cover plate 14 may comprise bottom cover plate clearance holes 236, each with optional counterbore, corresponding in position and size to cover plate pilot holes 34 of first and second projection elements 28 and 30 of lower tool mount body 6. Bottom cover plate clearance holes 236 may be capable of receiving M8 screws, namely bottom cover plate screws 238 that may fasten through bottom cover plate clearance holes 236 and into cover plate pilot holes 34 of first and second projection elements 28 and 30 of lower tool mount body 6, thereby capable of securing the bottom cover plate to lower tool mount body. Further, bottom cover plate 14 may comprise a sensor package window 240 and a pair of window flanges 242. In embodiments, sensor package window 240 may be an open window that allows for sensor package 16, which may be housed within biasing element recess 24 of lower tool mount body 6, exposure to external environments. Further, the pair of window flanges 242, which may be disposed on a top surface of bottom cover plate 14, may be configured to protect sensor package window 240 as well as underlying sensor package 16. In order to couple sensor package 16 to an underside of bottom cover plate 14, bottom cover plate 14 may comprise a sensor package securing means 244, as illustrated in FIG. 6B. In embodiments, sensor package securing means 244 may comprise a threaded holder 246 and a locking nut (not illustrated) to fix sensor orientation. Threaded holder 246 may comprise a sensor package pilot hole 250 configured to receive a threaded end 252 of sensor package 16, one or more threaded holder pilot holes 254 that correspond to one or more threaded holder clearance holes 256 disposed through bottom cover plate 14. In embodiments, threaded holder screws 258 may fasten through threaded holder clearance holes 256 and into threaded holder pilot holes 254, thus securing threaded holder, and by extension sensor package 16, to the underside of bottom cover plate 14. Sensor package 16 may comprise one or more sensors capable of obtaining at least pressure, temperature, accelerometer, and magnetometer measurements which may allow an operator to determine casing collar location in a cased-hole section of the wellbore, and thus provide a down-hole tally record of casing. Further, sensor package 16 may be capable of being used in conjunction with other sensors disposed on down-hole tool-string 3 or wireline to determine a fluid I.D. of a wellbore.

Figures 7A, 7B:
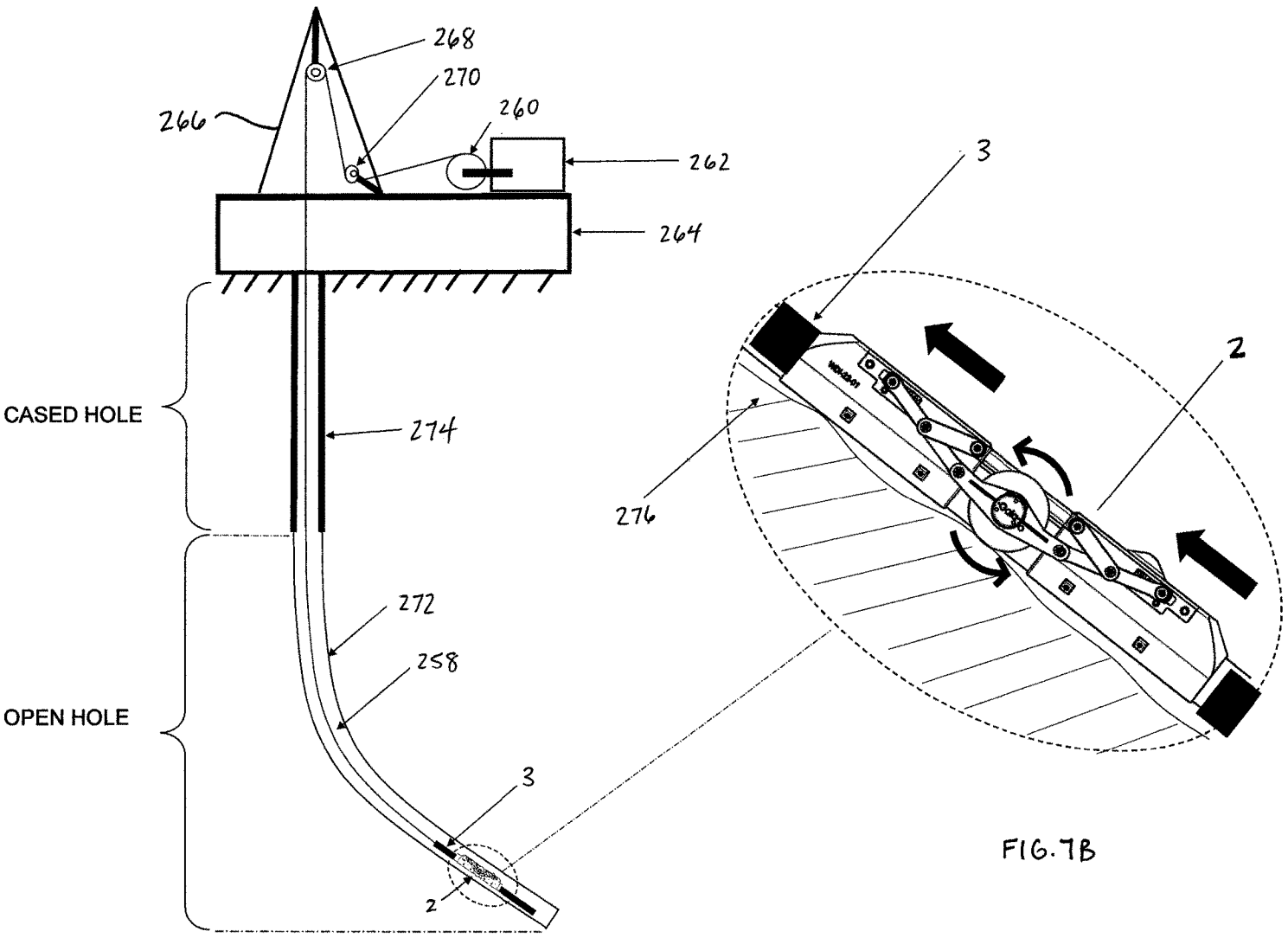
FIG. 7A illustrates a wellbore depth instrument installed on a downhole tool-string in relation to a wireline cable, wellbore, and casing in accordance with one embodiment of the present invention.
FIG. 7B illustrates a close-up view of a wellbore depth instrument in relation to a wellbore wall in accordance with one embodiment of the present invention.

FIG. 7A illustrates a generic logging operation that includes a WDI 2 disposed on downhole tool-string 3 in accordance with one embodiment of the present invention. As illustrated, plurality of WDI 2 may be mounted onto a downhole tool-string 3 disposed on a wireline cable 258. Cable 258 may be, for example, stored on a wireline drum 260 and spooled into the wellbore by a winch driver and logging engineer in a logging unit 262. In the illustrated embodiment, logging unit 262 may be fixed to the drilling rig or platform 264, and cable 258 may be deployed through a derrick 266 via at least two sheaves such as an upper sheave 268 and a lower sheave 270 to any depth of the wellbore. The wellbore may have an open-hole portion 272 and/or cased-hole portion 274. FIG. 7B illustrates a close-up view of WDI 2 mounted to downhole tool-string 3. In the illustration of FIG. 7B, WDI 2 may be seen in relation to downhole tool-string 3, a wellbore wall 276.

In embodiments, WDI may comprise two independent traction wheels 82 that may be suspended by spring-loaded Scott-Russel linkages 74 and 76 which may permit tracking of wellbore features (rugosity) whilst recording wheel rotations (angular velocity, direction and cumulative rotations—to derive depth). Each traction wheel 82 comprises an electronics or memory recording data package 94 with multi-axis accelerometers. As traction wheels 82 rotate along the wellbore, independent of deviation, the accelerometers may generate sinusoidal signals in which the frequency may yield tool speed, the cumulative peaks and troughs may yield the distance travelled, and the direction may come from the signal character (e.g., signal inversion may imply a change in direction). Thus, down-hole depth along the wellbore may be measured and compared to surface readings, allowing tool-string position to be accurately determined to within a fraction of an inch in good hole conditions. Further, point to point measurements (e.g., between adjacent station logs) may be highly accurate with WDI 2.

Although the present invention and its advantages have been described in detail, it should be understood that various changes, substitutions and alterations may be made herein without departing from the spirit and scope of the invention as defined by the appended claims.

What is claimed is:

1. A measurement device for a wellbore comprising:

an upper and lower tool mount body, each comprising a laterally extending cylindrical bore that allows the upper and lower tool bodies to mount onto a tool-string;

a pair of side rails, each comprising an upper portion, a lower portion, and a center portion, wherein the upper portion of each of the pair of side rails is coupled to the upper tool mount body on opposing sides, wherein the lower portion of each of the pair of side rails is coupled to the lower tool mount body on opposing sides, wherein the center portion provides separation between the upper and lower tool mount bodies, and wherein the coupling of the pair of side rails to the upper and lower bodies form a combined upper/lower tool mount body; and a pair of wheel suspension assemblies coupled to the combined upper/lower tool mount body on opposing sides, each comprising:

a wheel assembly comprising a traction wheel and an electronics package, wherein the electronics package is capable of recording in memory rotations of the traction wheel and frequency of the rotations;

an upper and lower biasing element; and an upper and lower Scott Russel linkage, wherein the upper Scott Russel linkage couples the wheel assembly to the upper tool mount body and the upper biasing element, and wherein the lower Scott Russel linkage couples the wheel assembly to the lower tool mount body and the lower biasing element, and wherein the upper and lower biasing elements of the pair of wheel suspension assemblies bias the upper and lower Scott Russel linkages of the pair of wheel suspension assemblies in an axially inward direction, thereby biasing the traction wheels of the pair of wheel suspension assemblies in a downward direction perpendicular to the axial inward direction.

2. The measurement device of claim 1, wherein the biasing of the traction wheels allows the tractions wheels to remain in contact with a wall of the wellbore through upward and downward movement during a downhole operations run.

3. The measurement device of claim 1, wherein the upper and lower tool mount bodies each comprise at least one set of three fixing holes extending from an outer surface to an inner surface of the upper and lower tool mount bodies that fixing grub screws fasten into to secure the upper and lower tool mount bodies to the tool-string.

4. The measurement device of claim 1, wherein the upper and lower tool mount bodies each comprise a biasing element recess in which the biasing elements are disposed.

5. The measurement device of claim 1, wherein the pair of side rails each comprise two sliding element guide cutouts along which the upper and lower biasing elements slide.

6. The measurement device of claim 1, wherein the pair of wheel suspension assemblies are independently suspended.

7. The measurement device of claim 1, wherein the wheel assembly further comprises a wheel carrier in which to carry the traction wheel.

8. The measurement device of claim 7, wherein the traction wheel comprises a hub, a toothed circumference, and a fixed diameter.

9. The measurement device of claim 8, wherein the traction wheel is secured within the wheel carrier via a radial wheel guide, wherein the radial wheel guide comprises a radial wheel guide spigot that travels through a clearance hole of the wheel carrier and is received by a wheel alignment groove disposed on the hub of the traction wheel.

10. The measurement device of claim 1, wherein the wheel assembly further comprises an inner and outer bushing.

11. The measurement device of claim 1, wherein the wheel assembly further comprises a hubcap in which the electronics package is disposed.

12. The measurement device of claim 1, wherein the electronics package comprises a dual axis accelerometer, a microprocessor, and a battery.

13. The measurement device of claim 1, wherein the biasing elements comprise tension springs.

14. The measurement device of claim 1, further comprising a top and bottom cover plate for covering tops of the upper and lower tool mount bodies, respectively.

15. The measurement device of claim 14, further comprising a sensor package disposed on an underside of the bottom plate cover.

16. The measurement device of claim 15, wherein the sensor package is exposed to an external environment via a sensor package window disposed on the bottom cover.

17. The measurement device of claim 16, wherein the bottom cover comprises flanges to protect the sensor package window and the sensor package.

18. The measurement device of claim 16, wherein the sensor package is capable of recording at least pressure, temperature, accelerometer, and magnetometer measurements.

19. A method for determining well depth measurements along a wellbore comprising:

(A) mounting a wellbore depth instrument onto a tool-string designed for downhole operations, wherein the wellbore depth instrument comprises:

an upper and lower tool mount body, each comprising a laterally extending cylindrical bore that allows the upper and lower tool bodies to mount onto a tool-string;

a pair of side rails, each comprising an upper portion, a lower portion, and a center portion, wherein the upper portion of each of the pair of side rails is coupled to the upper tool mount body on opposing sides, wherein the lower portion of each of the pair of side rails is coupled to the lower tool mount body on opposing sides, wherein the center portion provides separation between the upper and lower tool mount bodies, and wherein the coupling of the pair of side rails to the upper and lower bodies form a combined upper/lower tool mount body;

a pair of wheel suspension assemblies coupled to the combined upper/lower tool mount body on opposing sides, each comprising:

a wheel assembly comprising a traction wheel and an electronics package;

an upper and lower biasing element; and an upper and lower Scott Russel linkage, wherein the upper Scott Russel linkage couples the wheel assembly to the upper tool mount body and the upper biasing element, and wherein the lower Scott Russel linkage couples the wheel assembly to the lower tool mount body and the lower biasing element, and wherein the upper and lower biasing elements of the pair of wheel suspension assemblies bias the upper and lower Scott Russel linkages of the pair of wheel suspension assemblies in an axially inward direction, thereby biasing the traction wheels of the pair of wheel suspension assemblies in a downward direction perpendicular to the axial inward direction, wherein the biasing of the traction wheels allows the tractions wheels to remain in contact with a wall of the wellbore through upward and downward movement during a downhole operations run;

(B) running the tool-string up or down the wellbore, thereby causing rotation of the traction wheels;

(C) allowing the electronics packages to record in memory rotations of their respective traction wheels and frequencies of the rotations; and (D) determining well depth measurements along the wellbore via the recorded rotations of the traction wheels and frequencies of the rotations.

20. The method of claim 19, further comprising determining dynamics of the string comprising tool-string speed, direction, stick slip, creep and hold-ups via the recorded rotations of the traction wheels and frequencies of the rotations.

* * * * *